United States Patent [19]

Kawauchi et al.

[11] Patent Number: 4,988,913

[45] Date of Patent: Jan. 29, 1991

[54] FLAT CONFIGURATION CATHODE RAY TUBE

[75] Inventors: Yoshikazu Kawauchi, Yokohama; Hiroshi Miyama, Yokohama; Kaoru Tomii, Isehara; Jun Nishida, Tokyo, all of Japan

[73] Assignee: Matsushita Electric Industrial Co., Ltd., Japan

[21] Appl. No.: 334,517

[22] Filed: Apr. 7, 1989

[30] Foreign Application Priority Data

Apr. 8, 1988 [JP] Japan ..... 63-87484
Apr. 8, 1988 [JP] Japan ..... 63-87485

[51] Int. Cl.[5] ..... H01J 29/70

[52] U.S. Cl. ..... 313/422; 313/452; 313/482

[58] Field of Search ..... 313/422, 452, 482

[56] References Cited

U.S. PATENT DOCUMENTS 4,703,231 10/1987 Tomii et al. ..... 313/422
4,752,721 6/1988 Nishida et al. ..... 313/422
4,804,887 2/1989 Miyama et al. ..... 313/422

FOREIGN PATENT DOCUMENTS 60-193242 1/1985 Japan .
60-189848 9/1985 Japan .
62-58554 3/1987 Japan .

*Primary Examiner*—Donald J. Yusko
*Assistant Examiner*—Diab Hamadi
*Attorney, Agent, or Firm*—Lowe, Price, Leblanc, Becker & Shur

[57] ABSTRACT

A flat configuration CRT has a plurality of line cathodes arrayed with a predetermined pitch, a focus electrode section for focusing respective electron beams which are emitted for the line cathodes, and pairs of deflection plates having opposed deflection electrodes for executing deflection of the focussed electron beams, the deflection electrodes of each deflection plate being divided into at least two parts, and an image display section upon which the electron beams are incident. The length of a region in which deflection is executed by the deflection electrodes is made no greaer than a value which is approximately three times the pitch of the line cathodes.

10 Claims, 8 Drawing Sheets

FLAT CONFIGURATION CATHODE RAY TUBE

The present application is related to the co-pending, commonly assigned, application of Kaoru TOMII, Hiroshi MIYAMA, Yoshikazu KAWAUCHI and Jun NISHIDA, Ser. No. 185,628, filed April 25, 1988, now U.S. Pat. No. 4,920,410, entitled "Drive Method for Synchronizing Scanning and Modulation of Flat-Configuration Color CRT".

BACKGROUND OF THE INVENTION

1. Field of Applicable Technology

The present invention relates to a flat configuration cathode ray tube for applications such as a color television receiver, computer display terminal, etc.

2. Prior Art Technology

In recent years, display units which are thin in shape have come to be increasingly utilized for display of images and characters. The flat configuration cathode ray tube is one type of such an apparatus, for example as described in Japanese patent laid-open Nos. 60-189848 and 60-193242.

FIG. 1 is an oblique view of a prior art flat configuration CRT, formed of electrodes which are contained within an external vacuum sealed container, e.g. a glass vacuum vessel, and FIG. 2 is a corresponding partial plan cross-sectional view. For clarity of description, most of this containing vessel has been omitted from the drawings. The horizontal display direction of images or characters displayed by the CRT is indicated by a horizontal arrow H, and the vertical display direction by a vertical arrow V. A plurality of mutually separate line cathodes 101, each extending in the vertical direction, are arrayed with a fixed pitch along the horizontal direction. The line cathodes 101 are each formed of tungsten wire having a surface coating of a cathode oxide. The number of line cathodes 101 and the pitch, where the term "pitch" as used herein signifies a value of regular spacing between linearly arrayed elements at which they are arrayed are optional. However assuming for example that the display image size is 10 inches, then the array pitch of the line cathodes 101 would be 10 mm, and 20 line cathodes would be used, each having a vertical height of 160 mm. An image display section 102 is separated from the line cathodes 101 by a predetermined spacing. Vertical scanning electrodes 103 are disposed behind the line cathodes 101. Each of the vertical scanning electrodes 103 is elongated in the horizontal direction, and the electrodes are arrayed with a fixed pitch in the vertical direction, and supported such as to be mutually electrically isolated upon a supporting member 104. In general, the number of the vertical scanning electrodes 103 is 1/n times the total number of horizontal scanning lines of the display, where n is an integer. However in this example it will be assumed that the number of these vertical scanning electrodes 103 is identical to the number of horizontal scanning lines (i.e. if the CRT is to be utilized for a usual television display, approximately 480 lines, for the NTSC standard). Between the line cathodes 101 and the image display section 102 are successively positioned, extending from the line cathodes 101, a set of first grid electrodes (hereinafter abbreviated to G1 electrodes) 105, a second grid electrode (hereinafter abbreviated to G2 electrode) 106, a third grid electrode (hereinafter abbreviated to G3 electrode) 107, and a fourth grid electrode (hereinafter abbreviated to G4 electrode) 108. The G1 electrodes 105 each are respectively identical and electrically separate flat-shaped electrodes having respective apertures 109 (shown in FIG. 2) formed therein, with the apertures being positioned in correspondence with respectively ones of the line cathodes 101 as indicated in FIG. 2. The G2 to G4 electrodes are each formed as a thin flat plate, with apertures formed therein. Respective video signals are applied to the G1 electrodes 105, for executing electron beam modulation. The G2 electrode 106 and the G3 electrode 107 have respective apertures 110 and 111 (shown in FIG. 2) formed therein which are positioned in correspondence with the apertures of the G1 electrodes 105, but are not divided in the vertical direction. The G4 electrode 108 has apertures 112 formed therein which may be identical to the apertures 110, 111 of the G2 electrode 106 and G3 electrode 107 respectively, or which may be of greater width in the horizontal direction than in the vertical direction as illustrated in FIG. 1. Between the G4 electrode 108 and the image display section 102 are disposed a set of horizontal deflection plates 113, having mutually opposing pairs of horizontal scanning electrodes 115A, 115B and 115C formed thereon as shown. Each of these pairs of horizontal scanning electrodes consists of vertically extending electrodes which are positioned symmetrically with respect to the axis of a corresponding electron beam which is emitted from the line cathodes 101 (as described in detail hereinafter). The centers of these pairs of horizontal scanning electrodes are spaced at regular intervals which are identical to the pitch of the line cathodes 101. The horizontal deflection electrodes 115A, 115B and 115C are formed by means such as etching of a metallic layer formed by metal plating or evaporative deposition upon surfaces of supporting members 114, each of which is formed of an electrically insulating material. As a result of voltages applied thereto, the horizontal deflection electrodes 115A, 115B and 115C execute horizontal electron beam focusing, electron beam horizontal deflection, and beam acceleration.

A photo-emissive layer consisting of a screen phosphor layer 116 and a metal back layer electrode 117 is formed on the inner surface of a portion of the glass containing vessel, to thereby constitue an image display section 102. The phosphor layer 116 is formed of red (R), green (G) and blue (B) stripes or dots arrayed successively along the horizontal direction, in the case of a color display.

The operation of this flat configuration CRT is as follows. Heating currents are caused to flow in the line cathodes 101 shown in FIG. 1, which are fixed at a common potential, while a potential that is more negative than that common potential is applied to all of the vertical scanning electrodes 103 other than a currently selected one of the vertical scanning electrodes 103. Respective electron beams, arrayed along a horizontal line corresponding to the selected one of the vertical scanning electrodes 103, are thereby emitted from the vertical scanning electrodes 103, towards the G1 electrodes 105 and the G2 electrode 106. A potential which is higher than that of the line cathodes 101 by approximately 100 to 500 V is applied to the G2 electrode 106, causing the electron beams to pass through respective ones of the apertures 110, 111 formed in the G1 electrodes 105 and G2 electrode 106 respectively, after having passed through the apertures 109 of the G1 electrodes 105. Control of the level of current of each electron beam is executed by varying the voltage which is applied to the corresponding one of the G1 electrodes 105. After passing through the apertures 110 of the G2 electrode 106, the electron beams pass through the apertures of the G3 electrode 107 and G4 electrode 108, then pass midway between respective ones of the pairs of mutually opposing sets of horizontal deflection electrodes 115A, 115B and 115C. Predetermined voltages are applied to the above electrodes, for causing the electron beams to form respective small spots on the phosphor layer of the image display section 102. Focussing of each beam in the vertical direction is implemented by a static electron lens which is formed at the exit from a corresponding one of the apertures 112 of the G4 electrode 108, while beam focusing in the horizontal direction is implemented by an electron lens formed by the horizontal deflection electrodes. Horizontal focus adjustment can be executed by variation of the center values of respective voltages which are applied between each of the opposing pairs of horizontal deflection electrodes 115A, 115B and 115C, The horizontal deflection electrodes 115A, 115B and 115C are mutually interconnected by respective pairs of common conductors 115A-a,b 115B-a,b and 115C-a,b. During each horizontal scanning interval, a sawtooth waveform deflection voltage or a staircase waveform deflection voltage is applied between each of these pairs of common conductors, superimposed upon the respective focus voltages. The respective electron beams are thereby deflected through a predetermined horizontal scanning width as they fall on the phosphor layer 116 of the image display section 102, to produce emission of light. In the case of a color display CRT, timing control of the modulation signals which are applied to the G1 electrodes 105 can be synchronized with timings at which the electron beams fall upon respective color stripe or dot portions of the phosphor layer 116 of the image display section 102 during each horizontal sweep.

Vertical scanning will be described referring to FIGS. 3 and 4. As stated above, control of electron emission from the line cathodes 101 is executed by selectively determining the voltages applied to respective ones of the vertical scanning electrodes 103. Specifically, the potential of the space surrounding a line cathode, adjacent to a specific one of the vertical scanning electrodes 103, is made positive or negative with respect to the potential of the line cathodes 101, in accordance with the voltage applied to that vertical scanning electrode. Electron beam switching for vertical beam scanning is thereby implemented. The smaller the spacing between the line cathodes 101 and the vertical scanning electrodes 103, the smaller will be the level of voltage that is required to control ON/OFF switching of the electron beams emitted from the line cathodes 101. If interlace scanning is used, then vertical scanning signals will be applied to the vertical scanning electrodes 103 during a first field interval (i.e. a first vertical scanning interval, designated as 1 $V_A$ in FIG. 4) such that a condition in which electron beams are generated (referred to in the following simply as the ON state) is produced during the first horizontal scanning interval (i.e. 1 H interval) at the start of the field interval by the vertical scanning electrode 103A, as illustrated in FIG. 4. During the next 1 H interval, a signal is applied to the vertical scanning electrode 103C to establish the electron beam ON state, and thereafter signals are successively applied to the remainder of the odd-numbered vertical scanning electrodes to successively establish the electron beam ON state during sequential 1 H intervals. This is terminated when vertical scanning electrode vertical scanning electrodes 103 at the bottom of the display is reached. During the succeeding field interval (indicated in FIG. 4 as 1 $V_B$) signals to establish the electron beam ON condition are applied during respective 1 H intervals to the even-numbered vertical scanning electrodes, beginning with electrode 103B and terminating with electrode 103Y.

Referring to FIGS. 5 and 6, a description will be given of a signal processing system for supplying signals to the G1 electrodes of a flat configuration CRT such as that described above, having a plurality of electron beam sources arrayed along the horizontal direction, for the case of application to a television display. A timing pulse generator 144 generates timing pulses to be applied to drive circuits that are described hereinafter, in response to a television sync signal 142. A corresponding television video signal 141 is converted to successive digital data values by an analog/digital converter 143, and a set of these data values are sequentially inputted to a line memory 145 during a 1 H interval. When all of the set of data values for a 1 H interval have been supplied to the line memory 145, the data values are then simultaneously transferred to a second line memory 146, and during the succeeding 1 H interval a new set of digital data values are inputted to the line memory 145. The data values which have been transferred to the line memory 146 are held therein during a 1 H interval, and are transferred to a digital/analog converter (or pulse-width converter) 147, to be converted to corresponding analog signals (or pulse-width modulated signals). These are amplified, and applied to the G1 electrodes 105 of the CRT. The line memories are thereby used to perform time-axis conversion, as can be understood referring to FIG. 6. Designating the number of electron beams that are used to scan the display region (i.e. the number of line cathodes) as A, and the duration of a horizontal scanning interval (1 H) of the video signal as T, a portion of the input video signal 151 in FIG. 6 that occurs during an interval T within a 1 H interval is divided into A segments, each having a duration of T/A. The duration of these signal segments is then multiplied by the factor A, to thereby extend that duration to become equal to T. An example of a time-axis expanded signal segment is designated as 152 in FIG. 6. This process is executed for the entirity of each 1 H interval of the input video signal, and as a result of sequential scanning in the vertical direction by the scanning signals applied to the vertical scanning electrodes 103, a complete display image is produced.

In order to implement electron beam horizontal focusing and deflection by the horizontal deflection deflection plates 113 described above, deflection voltages having a periodic waveform such as a sawtooth waveform are applied to the deflection plates for executing horizontal deflection, together with DC voltages superimposed thereon for executing horizontal focusing. The levels of these DC voltages are approximately in the range 1 to 20 KV. Since the horizontal deflection electrodes 115A, 115B and 115C are formed directly upon the supporting members 114, e.g. by etching of a metallic layer formed on the supporting member surface, electrical discharge or insulation breakdown can readily occur in regions between mutually adjacent ones of the horizontal deflection electrodes 115A, 115B and 115C. Structures for such horizontal deflection plates have been proposed in the prior art for overcoming this problem, for example as described in Japanese patent laid-open No. 62-58554.

Such horizontal deflection plates will be described referring to FIGS. 7 and 8, which are respective oblique views of two examples of a pair of such prior art deflection plates. Each deflection plate consists of a supporting member 118 formed of an electrically insulating material, with three horizontal deflection electrodes 119*a*, 119*b* and 119*c* mounted thereon (only the electrodes mounted upon one face of each supporting member being shown, for simplicity of description). In the example of FIG. 7, the horizontal deflection electrodes 119*a* and 119*c* are formed directly upon a surface of a supporting member 118, as in the preceding prior art example, e.g. by etching of a metallic layer formed by a process such as evaporative deposition, while a centrally situated horizontal deflection electrode 119*b* is raised outward from the surface of the supporting member 118 by being mounted on a spacer which is attached to that surface, e.g. attached by glass frit. The horizontal deflection electrode 119*b* may be formed of metal plate. In the example of FIG. 8, each of the supporting members 118 has a horizontal deflection electrode 121*c* formed on a surface thereof in the same way as for electrodes 119*c*, 119*a* in FIG. 7. However the remaining two electrodes 121*a* and 121*b* are separated from the supporting member surface by different heights, by being respectively mounted on spacers 123, 122 which are of different width as measured perpendicular to the supporting member surface. Each of the horizontal deflection electrodes 121*a* (or 119*a* in FIG. 7) is situated at the low-voltage end of the deflection plates, i.e. is subjected to a relatively low DC focusing voltage, while the horizontal deflection electrodes 121*c* (or 121*c* in FIG. 8) are situated at the high-voltage end of the deflection plates, and the horizontal deflection electrodes 121*b* (or 119*b* in FIG. 7) are positioned intermediate between the high and low voltage ends of the deflection plates.

Although some improvement with respect to electrical discharge or insulation breakdown occurring between adjacent horizontal deflection electrodes is provided by these prior art examples when applied to a flat configuration CRT, by comparison with the simple horizontal deflection electrode configuration of FIGS. 1 and 2, the degree of improvement is not sufficient to enable satisfactory levels of horizontal focus voltages to be applied to the horizontal deflection plates of a very thin and compact flat configuration CRT. These problems of electrical discharge or insulation breakdown are made more severe as a result of electrical charge buildup which can occur in regions of the surface of each supporting member 118 between adjacent ones of the horizontal deflection electrodes, or the surfaces of the spacers, as a result of the electron beams passing between the electrodes or due to emission of secondary electrons from the image display section.

In addition, both with a prior art flat configuration CRT having horizontal deflection plates as shown in FIG. 1 and a CRT utilizing horizontal deflection plates as shown in FIGS. 7 or 8, there is a basic problem with respect to ensuring a satisfactory degree of vertical focus. Specifically, electron beam focussing in the vertical direction is mainly executed immediately after each beams exits from a corresponding one of the small apertures formed in the G4 electrode 108, i.e. respective electron lenses are formed. However each of these has a short focal length and a small depth of focus. Thus, the longer the distance which must be traversed after passing through such a vertical focus lens formed by the G4 electrode 108 until the image display section 102 is reached, the poorer will be the sharpness of vertical focus. It is therefore necessary to restrict the distance from the G4 electrode 108 to the image display section 102 to a sufficiently small value to obtain sharpness of vertical focus, (i.e. a small scanning spot width in the vertical direction). However in the prior art, that distance has not been determined on the basis of a requirement for sharpness of vertical focus, since a reduction of the distance results in a lowering of horizontal deflection sensitivity.

SUMMARY OF THE INVENTION

It is an objective of the present invention to overcome the problems of the prior art described above, by providing a flat configuration cathode ray tube whereby a satisfactory degree of vertical focusing is achieved while enabling the overall thickness of the cathode ray tube to be minimized.

It is a further objective of the present invention to provide a flat configuration cathode ray tube having horizontal deflection plates each provided with a plurality of mutually separate horizontal deflection electrodes, whereby electrical discharge and insulation breakdown between the horizontal deflection electrodes of a horizontal deflection plate is effectively suppressed.

To achieve the above objectives, a first embodiment of a flat configuration cathode ray tube according to the present invention comprises:

- a plurality of line cathodes for emission of electrons, successively arrayed with a predetermined pitch;
- a focus electrode section for focusing respective electron beams which are emitted from the line cathodes;
- deflection plates having deflection electrodes for executing horizontal deflection of the electron beams after focusing has been executed by the focus electrode section, the deflection electrodes being divided into at least two parts each formed of mutually opposing electrodes; and
- an image display section upon which the electron beams are incident, for displaying an image;
- in which the length of a region where deflection is executed by the deflection electrodes, as measured along the trajectory of an electron beam, is within a value which is three times the pitch of the line cathodes.

According to another embodiment, a flat configuration cathode ray tube according to the present invention is further characterized in that each of the deflection plates is formed of a supporting member formed of an electrically insulating material, with respective horizontal deflection electrodes mounted thereon, and in that at least a part of the deflection electrodes of each of the deflection plates are mounted on the corresponding electrically insulating material by spacer members, such that at least a portion of mutually adjacent ones of the deflection electrodes mutually overlap by a predetermined amount.

The deflection electrodes which are thus mounted on spacer members may be formed of metal plates, or of an electrically insulating material such as glass having a metallic film formed thereon.

A flat configuration cathode ray tube according to the present invention can thereby be made thinner than has been possible in the prior art, while greater reliability and stability of focus operation is ensured due to the suppression of electrical discharge or insulation breakdown between adjacent ones of deflection electrodes which must be utilized, due to space limitations, both for electron beam deflection and also for focusing the electron beams.

DESCRIPTION OF PREFERRED EMBODIMENTS

Figure 1:
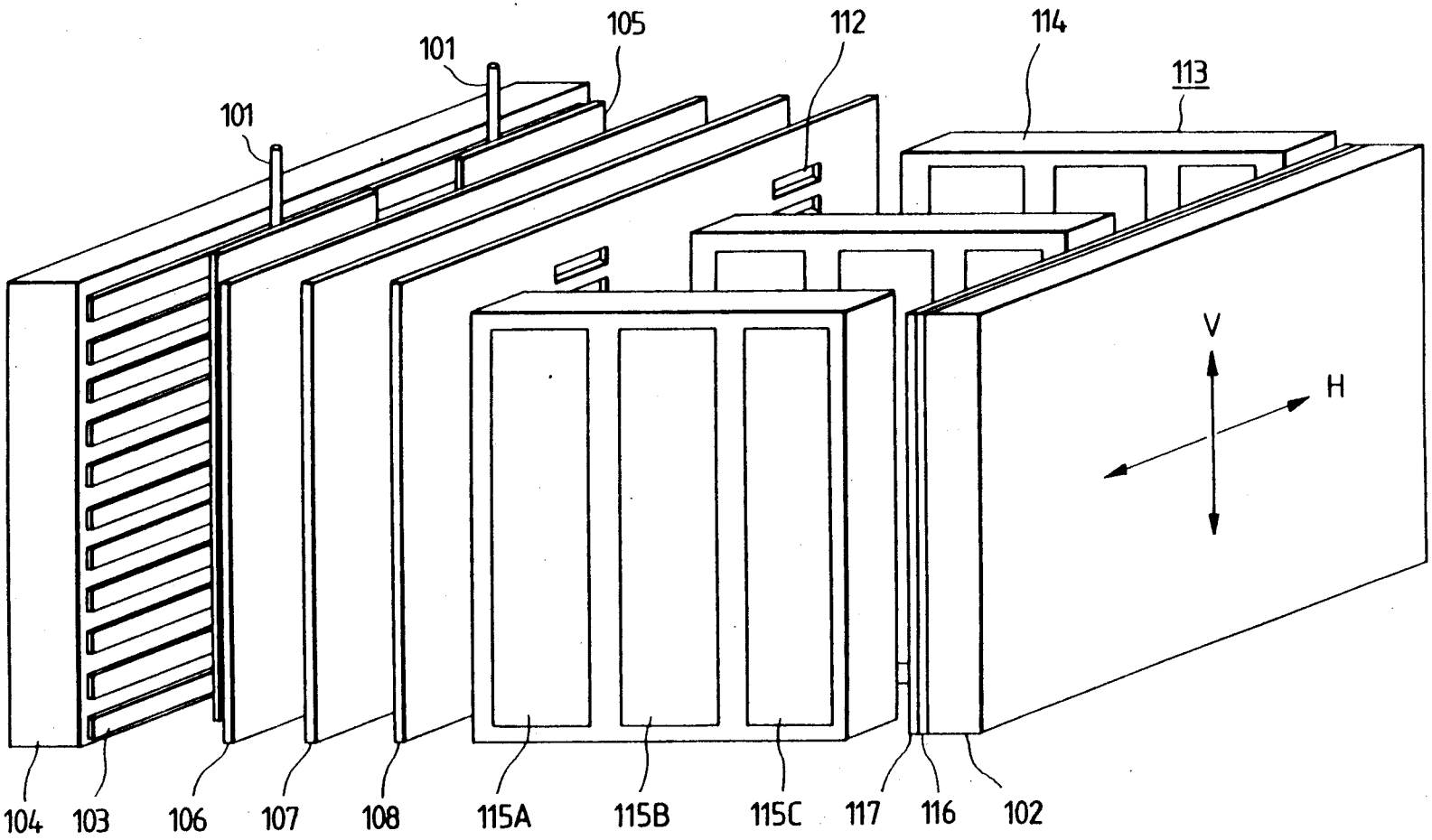
FIG. 1 PRIOR ART
FIG. 1 is an oblique view of the interior configuration of a prior art flat configuration CRT.
Figure 2:
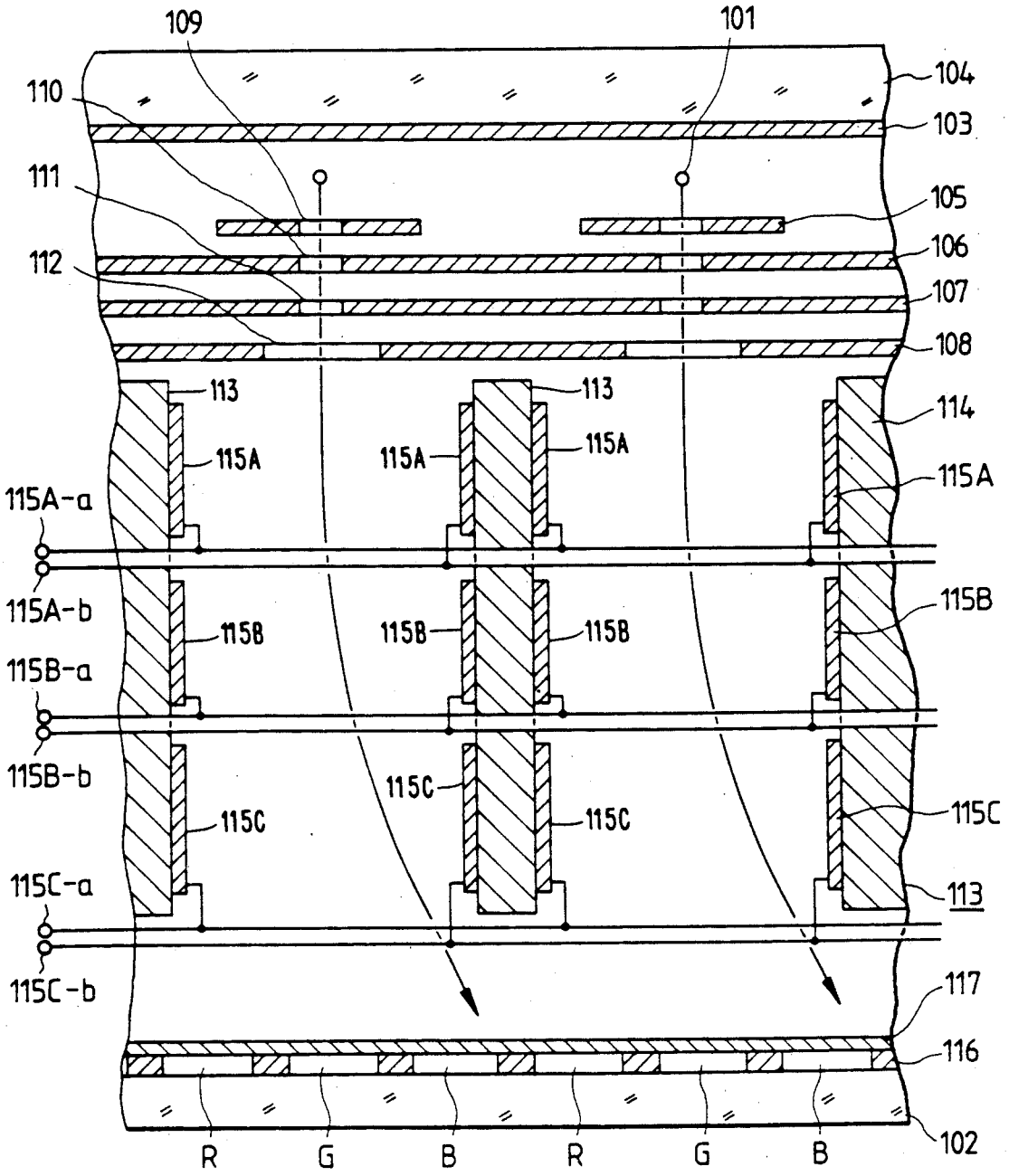
FIG. 2 PRIOR ART
FIG. 2 is a partial plan cross-sectional view of the CRT of FIG. 1.
Figure 3:
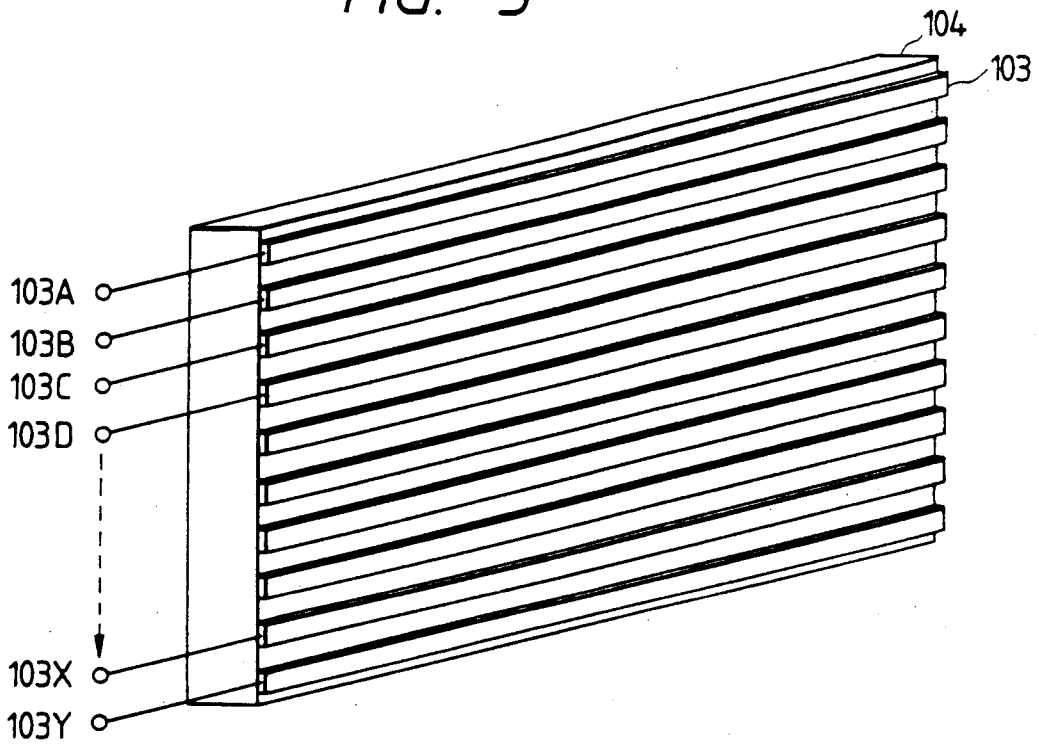
FIG. 3 is an oblique view of an array of vertical scanning electrodes in the CRT of FIG. 1.
Figure 4:
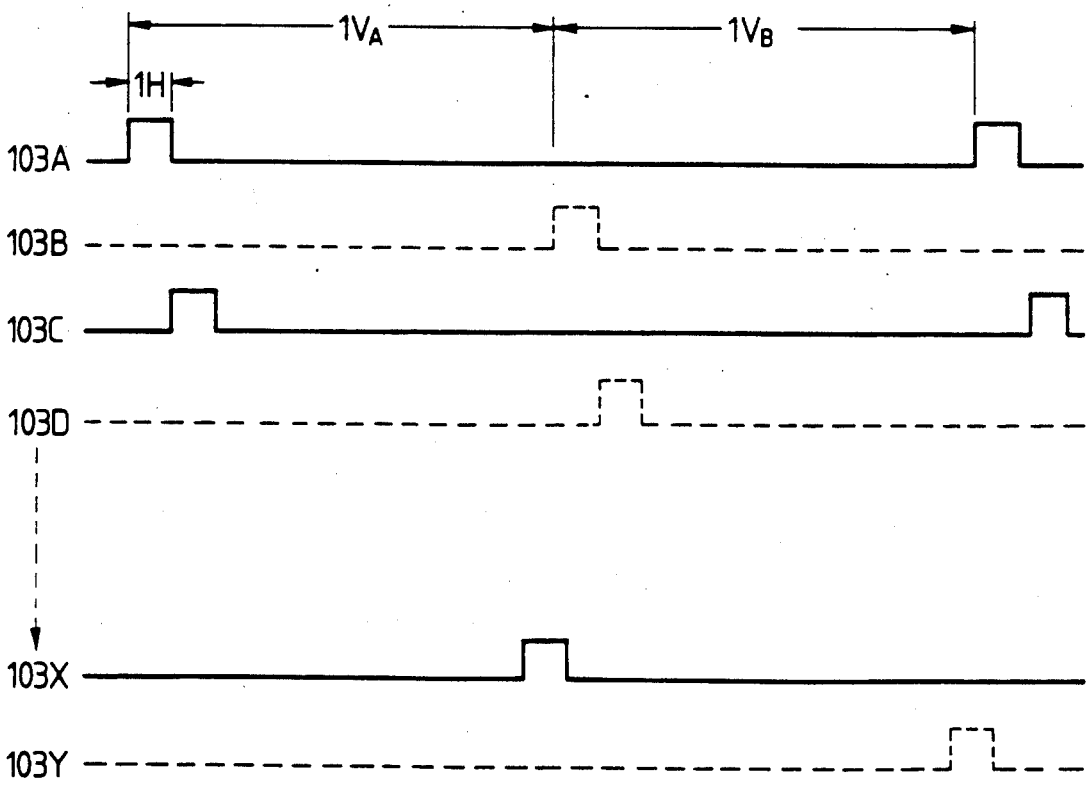
FIG. 4 is a timing chart for illustrating drive signals applied to the electrodes of FIG. 3.
Figure 5:
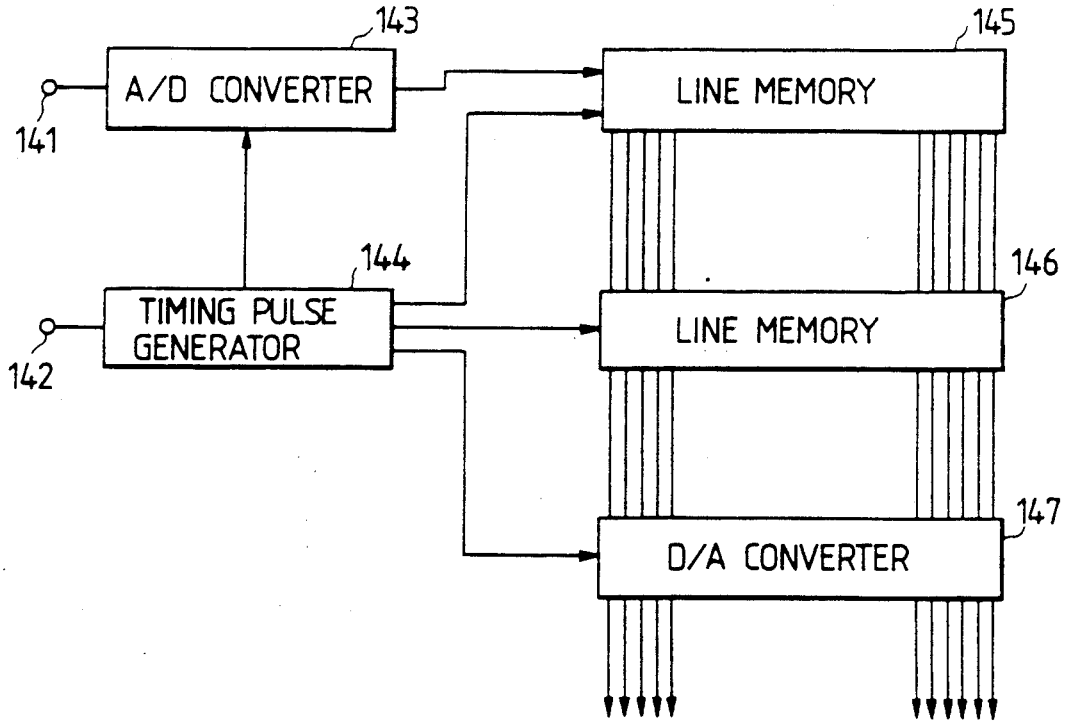
FIG. 5 is a general block diagram of circuits for applying modulation drive signals to the CRT of FIG. 1.
Figure 6:
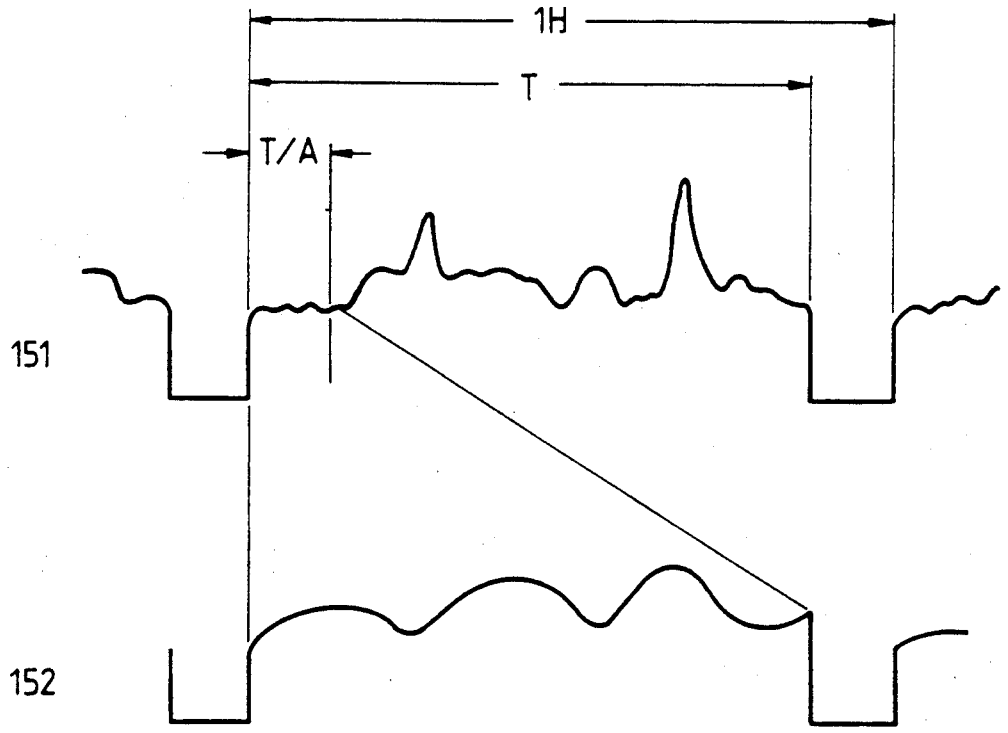
FIG. 6 is a waveform diagram for assistance in describing the operation of the circuits of FIG. 5.
Figure 7:
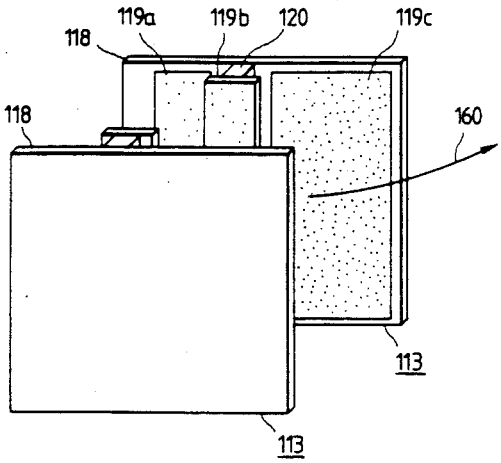
FIG. 7 PRIOR ART
FIGS. 7 and 8 are further examples of electron beam deflection plates for a prior art flat configuration CRT.
Figure 9:
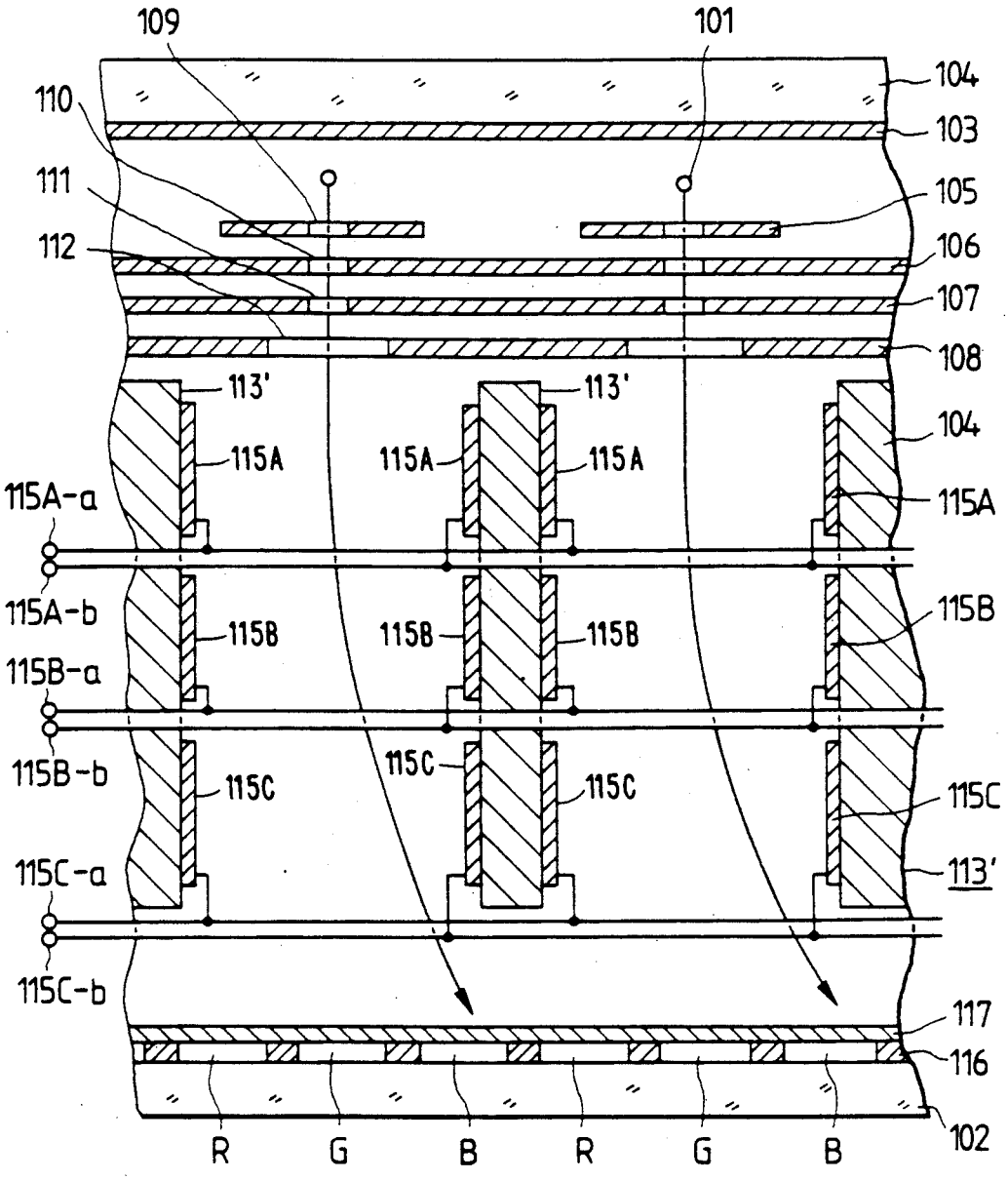
FIG. 9 is a partial plan cross-sectional view of a first embodiment of a flat configuration CRT according to the present invention.

The general configuration and functioning of a flat configuration CRT according to the present invention is substantially identical to that of the prior art flat configuration CRT shown in FIG. 1 and described above, so that further description of the internal arrangement and operation will be omitted. FIG. 9 is a partial plan cross-sectional view of a first embodiment of a flat configuration CRT according to the present invention. This differs from the prior art as illustrated in FIG. 2 in that the distance between the G4 electrode 108 and the image display section 102, i.e. the length (measured along the trajectory of an electron beam, assuming that the trajectory is oriented directly perpendicular to the image display section 102) of a region in which horizontal focusing is executed by a set of horizontal deflection plates 113', is approximately equal to, and no greater than, three times the pitch of the line cathodes 101.

Figure 10:
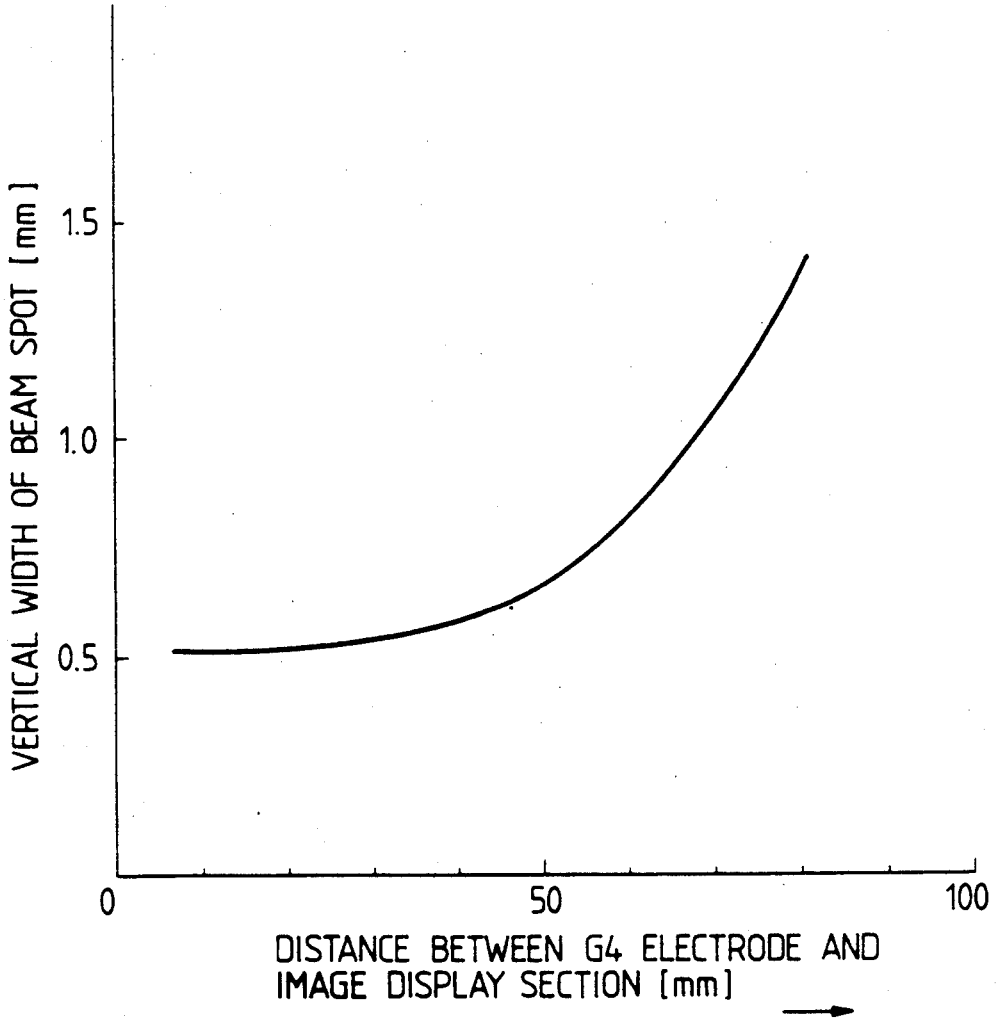
FIG. 10 is a graph showing the relationship between electron beam focus diameter and distance between a focus electrode of flat shape and an image display section.

FIG. 10 shows how the vertical beam focus diameter varies in accordance with changes in the distance between the G4 electrode 108 and the image display section 102. As is clear from FIG. 10, if the distance between the G4 electrode 108 and image display section 102 exceeds approximately 50 mm, the vertical beam focus diameter abruptly deteriorates. Assuming that the spacing pitch of the line cathodes 101 is approximately 15 mm, this value of 50 mm is approximately three times the pitch of the line cathodes 101. This distance determines the limit of the range of satisfactory focus of each of the vertical focus lenses that are formed by the apertures 112 in the G4 electrode 108. Thus in order to obtain a satisfactory vertical beam focus diameter, it is necessary to make the distance from the G4 electrode 108 to the image display section 102, i.e. the length of the horizontal deflection region that is defined by the horizontal deflection plates 113', no greater than approximately three times the pitch of the line cathodes 101.

Figure 8:
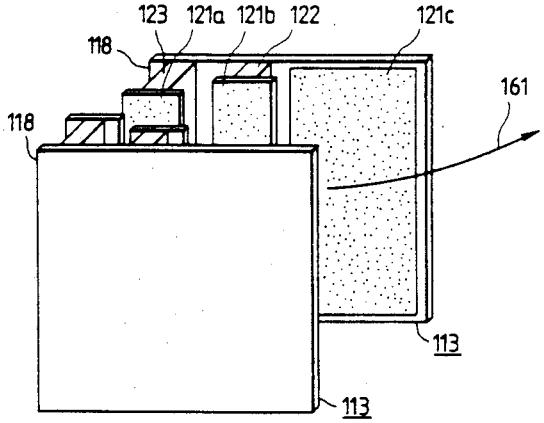
FIG. 8 PRIOR ART

The problem arises that if the length of the horizontal deflection region is reduced, then the deflection distance will fall. It is possible to overcome this problem by increasing the deflection sensitivity per unit of length (measured along the electron beam trajectory) of the horizontal deflection plates, or by increasing the deflection voltage levels applied to the horizontal deflection electrodes. If the horizontal deflection plates are made of the form shown in FIG. 8, with stepwise decrements in height of successive horizontal deflection electrodes successively occurring towards the high-voltage end of the deflection plates, then an increase in deflection sensitivity of 10% or higher can be achieved. However the amount of improvement in deflection sensitivity that can be obtained by such a deflection plate structure is limited, since if it is attempted to increase the sensitivity excessively then it is found that the horizontal focusing effectiveness of the deflection plates will deteriorate. To obtain an even greater improvement of deflection sensitivity, therefore, the deflection voltage levels applied to the horizontal deflection electrodes must be increased. If it is not possible to do this, because of limitations imposed by the withstanding voltage levels of the semiconductor elements of a horizontal deflection circuit (not shown in the drawings) which generates the horizontal deflection voltages, then an alternative solution is to use a screen phosphor layer for the image display section which has a low electron velocity excitation capability, i.e. which will enable sufficient display brightness to be obtained with a voltage of only several hundred volts applied to the image display section 102. With such a low level of voltage applied to the image display section 102, a satisfactory degree of horizontal deflection sensitivity can be obtained even if the length of the horizontal deflection region is made relatively short.

By ensuring that the distance between the vertical focusing electrode and the image display section is made sufficiently short, it is ensured that the image display section is brought within the range of sharp focus of the electron beam focusing lens that is formed by the vertical focusing electrode, so that improved vertical focus is achieved. This shortening of the horizontal deflection region also provides the advantage that the flat configuration cathode ray tube can be made of a thinner shape.

Figure 11:
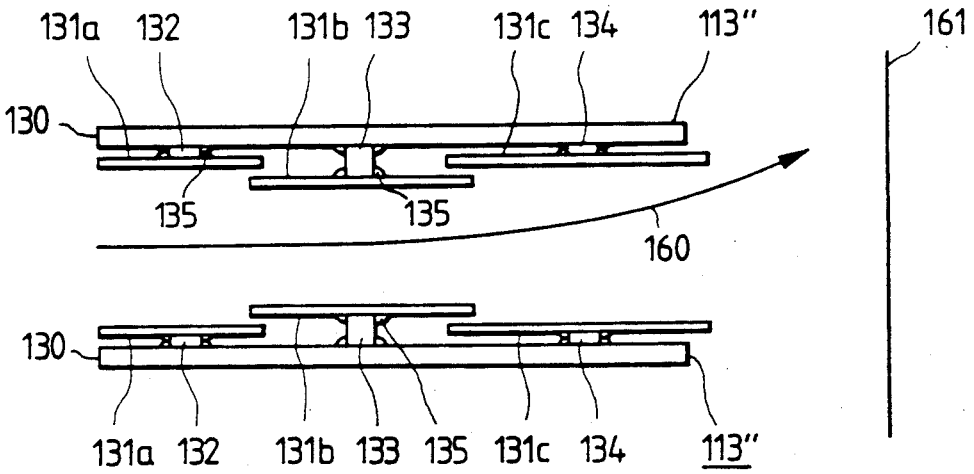
FIG. 11 and 12 are partial plan cross-sectional views for illustrating horizontal deflection plates for a second and a third embodiment of a flat configuration CRT according to the present invention respectively.

FIG. 11 is a plan view of a pair of horizontal deflection plates for a second embodiment of a flat configuration cathode ray tube according to the present invention. Only the deflection electrodes on one side of each deflection plate are shown, for simplicity of description. In FIG. 11, a pair of deflection plates 113'' are disposed mutually parallel, each having a set of deflection electrodes 131*a*, 131*b* and 131*c* attached to a supporting member 130 which is formed of an electrically insulating material, with the deflection electrodes 131*a*, 131*b* and 131*c* being positioned at differing heights over the supporting member and attached thereto by a long spacer 132, a short spacer 133, and a long spacer 134 respectively, and with mutually adjacent end portions of the deflection electrodes 131*a* and 131*b* and deflection electrodes 131*b*, 131*c* respectively mutually overlapping by predetermined amounts.

Although in this embodiment all of the deflection electrodes are mounted on spacers, this is not an essential feature, i.e. a part of the deflection electrodes of a deflection plate could be directly mounted on the supporting member 130. In addition, the respective amounts of overlap need not be identical. Moreover, it is not essential that all of the deflection electrodes mutually overlap, so long as at least a part of the deflection electrodes mutually overlap. For example, it can be arranged that overlap is provided between a pair of mutually adjacent deflection electrodes if the voltage difference between the deflection electrodes is 1 KV or higher. Each of the supporting members 130 is formed in the shape of a flat plate from an electrically insulating material such as glass. The deflection electrodes 131*a*, 131*b* and 131*c* can each be formed of metal plate, or from plates made of an electrically insulating material such as glass having a metal coating formed thereon. The deflection electrodes 131*a*, 131*b* and 131*c* are attached to the corresponding supporting member 130 by the spacers 132, 133 and 134, which serve to accurately define the spacing between each deflection electrode and the supporting member 130. The spacers are attached to the supporting member 130 by an attachment material 135, such as glass frit. Numeral 160 denotes an electron beam, and numeral 161 denotes the inner surface of the image display section upon which the electron beam is incident.

In the case of the configuration described above, assuming as an operating condition that the voltage applied to the image display section is 10 KV, then deflection center voltages respectively supplied to the deflection electrodes 131*a*, 131*b* and 131*c* of each deflection plate would be approximately 0.5 KV, 5 KV and 10 KV. Thus there will be a voltage difference of 4.5 KV between the electron beam deflection electrodes 131*b* and 131*c* of a deflection plate, and 5 KV between the deflection electrodes 131*a* and 131*b*. Accordingly, it is necessary for the deflection plates 113" to be capable of withstanding these voltage differences. With this embodiment, since the respective deflection electrodes 131*a*, 131*b* and 131*c* of a deflection plate are attached to the supporting member 130 by spacers 132, 133 and 134, the surface distances between the deflection electrodes are made long. Thus it is difficult for surface currents to flow across the spacers 132, 133, 134, and the supporting member 130. Furthermore, due to the fact that the deflection electrodes 131*a*, 131*b* and 131*c* mutually overlap, this serves to prevent the supporting member 130 from becoming electrically charged by the electron beam 160. Moreover, this overlap also has the effect of making the surface distances between the deflection electrodes longer, thereby further reducing the possibility of surface current flow or insulation breakdown occurring in the regions between adjacent horizontal deflection electrodes.

Thus with the embodiment described above, surface current flow and electrical charge build-up are effectively prevented, whereby insulation breakdown between the deflection electrodes is prevented, thereby ensuring stable deflection plate operation.

Figure 12:
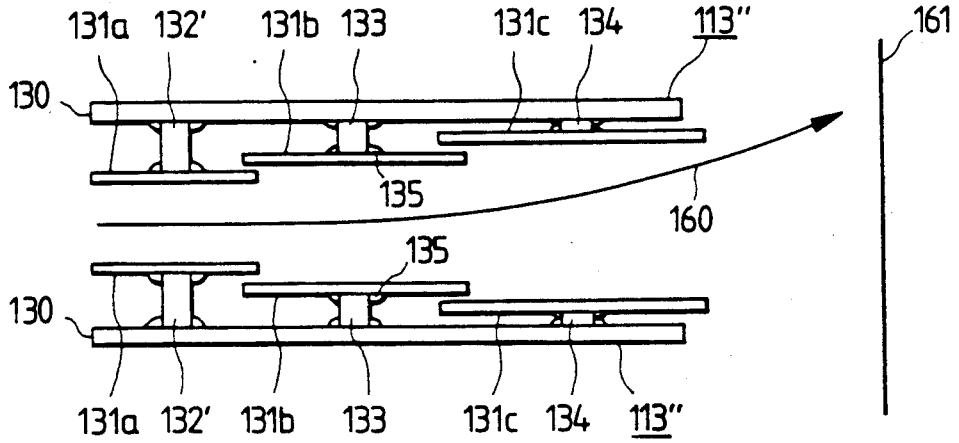

Deflection plates for a third embodiment of the present invention are illustrated in plan view in FIG. 12. This differs from the second embodiment in that the deflection electrode 131*a* of each deflection plate is held substantially distant from the supporting member 130 by a long spacer 132'.

The results obtained with this embodiment are similar to those obtained with the second embodiment described above, with insulation breakdown or surface current flow between the deflection electrodes being effectively prevented.

The above embodiments have been described for the case in which the deflection electrodes are divided into three pairs. However the invention is of course not restricted to such an arrangement.

Furthermore, although the deflection plates of FIGS. 11 and 12 have been described for use as horizontal deflection plates, it would also be possible to apply such plates as vertical deflection plates.

What is claimed is:

1. A flat configuration cathode ray tube comprising:

a plurality of line cathodes for emission of electrons, successively arrayed with a predetermined pitch;

a focus electrode section for focusing respective electron beams which are emitted from the line cathodes;

deflection plates having deflection electrodes for executing deflection of the electron beams after focusing has been executed by the focus electrode section, the deflection electrodes being divided into at least two parts each formed of mutually opposing electrodes; and an image display section upon which the electron beams are incident display an image;

in which the length of a region where deflection is executed by the deflection electrodes, as measured along an electron beam trajectory, is no greater than a value which is substantially equal to three times the pitch of the line cathodes.

2. A flat configuration cathode ray tube according to claim 1, in which the image display section includes a layer of photoemissive material having a low electron velocity excitation property.

3. A flat configuration cathode ray tube according to claim 1, in which each of the deflection plates comprises a supporting member formed of an electrically insulating material, with respective electrodes mounted thereon, and in which the deflection electrodes of each of the deflection plates are mounted on the corresponding supporting member by spacer members, such that at least a portion of mutually adjacent ones of the deflection electrodes mutually overlap by a predetermined amount.

4. A flat configuration cathode ray tube according to claim 1, in which each of the deflection plates comprises a supporting member formed of an electrically insulating material, with respective electrodes mounted thereon, and in which at least one of the deflection electrodes of each of the deflection plates is directly formed on a surface of the corresponding deflection plate and the remainder of the deflection electrodes of the deflection plate mounted on the corresponding supporting member by spacer members, such that at least a portion of mutually adjacent ones of the deflection electrodes mutually overlap by a predetermined amount.

5. A flat configuration cathode ray tube according to claim 3, in which each of the deflection electrodes which are mounted on the spacer members comprises a metal plate.

6. A flat configuration cathode ray tube according to claim 3, in which each of the deflection electrodes which are mounted on the spacer members comprises a plate formed of an electrically insulating material having a metallic film formed thereon.

7. A flat configuration cathode ray tube according to claim 2, in which each of the deflection plates comprises a supporting member formed of an electrically insulating material, with respective electrodes mounted thereon, and in which the deflection electrodes of each of the deflection plates are mounted on the corresponding supporting member by spacer members, such that at least a portion of mutually adjacent ones of the deflection electrodes mutually overlap by a predetermined amount.

8. A flat configuration cathode ray tube according to claim 2, in which each of the deflection plates comprise a supporting member formed of an electrically insulating material, with respective electrodes mounted thereon, and in which at least one of the deflection electrodes of each of the deflection plates is directly formed on a surface of the corresponding deflection plate and the remainder of the deflection electrodes of the deflection plate mounted on the corresponding supporting member by spacer members, such that at least a portion of mutually adjacent ones of the deflection electrodes mutually overlap by a predetermined amount.

9. A flat configuration cathode ray tube according to claim 4, in which each of the deflection electrodes which are mounted on the spacer members comprises a metal plate.

10. A flat configuration cathode ray tube according to claim 4, in which each of the deflection electrodes which are mounted on the spacer members comprises a plate formed of an electrically insulating material having a metallic film formed thereon.

* * * * *

UNITED STATES PATENT AND TRADEMARK OFFICE

CERTIFICATE OF CORRECTION

PATENT NO. : 4,988,913

DATED : January 29, 1991

INVENTOR(S) : Yoshikazu Kawauchi et al

It is certified that error appears in the above-identified patent and that said Letters Patent is hereby corrected as shown below: Title page:

Item [75] Inventors:
change "Yokohama" (first occurrence) to --Kawasaki--

Signed and Sealed this

Fourth Day of August, 1992

*Attest:*

DOUGLAS B. COMER

*Attesting Officer*

*Acting Commissioner of Patents and Trademarks*